US010863777B2

(12) United States Patent
Craig et al.

(10) Patent No.: US 10,863,777 B2
(45) Date of Patent: Dec. 15, 2020

(54) SOCK AND A METHOD FOR ITS MANUFACTURE

(71) Applicant: NIKE, Inc., Beaverton, OR (US)

(72) Inventors: Kenneth T. Craig, Beaverton, OR (US); Donna L. Marchant, Amsterdam (NL); Avi Cohen, Kfar Vradim (IL); David Malul, Karmiel (IL)

(73) Assignee: NIKE, Inc., Beaverton, OR (US)

( * ) Notice: Subject to any disclaimer, the term of this patent is extended or adjusted under 35 U.S.C. 154(b) by 98 days.

(21) Appl. No.: 16/123,862

(22) Filed: Sep. 6, 2018

(65) Prior Publication Data

US 2019/0000150 A1 Jan. 3, 2019

Related U.S. Application Data

(60) Division of application No. 14/266,023, filed on Apr. 30, 2014, now abandoned, which is a continuation-in-part of application No. 12/920,220, filed as application No. PCT/IL2007/001486 on Dec. 2, 2007, now abandoned.

(60) Provisional application No. 60/868,183, filed on Dec. 1, 2006.

(51) Int. Cl.

| | |
|---|---|
| ***A41B 11/01*** | (2006.01) |
| ***D04B 1/26*** | (2006.01) |
| ***A41B 11/00*** | (2006.01) |
| *D04B 1/10* | (2006.01) |

(52) U.S. Cl.

CPC ..... *A41B 11/01* (2013.01); *A41B 11/00* (2013.01); *A41B 2500/10* (2013.01); *D04B 1/108* (2013.01); *D04B 1/26* (2013.01)

(58) Field of Classification Search

CPC ..... A41B 11/004; A41B 11/001; A41B 11/01; A41B 2500/10; D04B 1/108; D04B 1/26; D04B 9/36; D04B 9/56

USPC ..... 2/239

See application file for complete search history.

(56) References Cited

U.S. PATENT DOCUMENTS

| | | | |
|---|---|---|---|
| 39,570 | A | 8/1863 | Harmon |
| 1,110,443 | A | 9/1914 | Kilbourn et al. |
| 1,234,703 | A | 7/1917 | Scott |
| 1,452,302 | A | 4/1923 | Loven |

(Continued)

FOREIGN PATENT DOCUMENTS

| | | | |
|---|---|---|---|
| EP | 1435206 | A1 | 7/2004 |
| EP | 1554940 | A1 | 7/2005 |

(Continued)

OTHER PUBLICATIONS

Extended Search Report dated Oct. 25, 2018 in European Patent Application No. 18191559.6, 8 pages.

(Continued)

*Primary Examiner* — Alissa L Hoey

(74) *Attorney, Agent, or Firm* — Shook, Hardy and Bacon LLP

(57) ABSTRACT

There is provided herein, a sock comprising a toe and/or a heel area, wherein said toe area is divided to at least two sub-areas, wherein a borderline between at least two adjacent sub-areas is essentially vertical. There is also provided, a method for manufacturing a sock comprising forming a toe and/or a heel area divided to at least two sub-areas, wherein a borderline between at least two adjacent sub-areas is essentially vertical.

9 Claims, 5 Drawing Sheets

(56) References Cited

U.S. PATENT DOCUMENTS

| | | | | |
|---|---|---|---|---|
| 1,496,724 | A | 6/1924 | Mirsky | |
| D71,790 | S | 1/1927 | Greco | |
| 1,680,859 | A | 8/1928 | Capareli | |
| D92,543 | S | 6/1934 | MacLear | |
| 1,974,993 | A | 9/1934 | Nebel | |
| 1,981,315 | A | 11/1934 | Goodman | |
| 2,002,888 | A | 5/1935 | Gastrich | |
| 2,018,248 | A | 10/1935 | Börner | |
| 2,179,336 | A | 11/1939 | Lawson | |
| 2,223,102 | A | 11/1940 | Grosse | |
| 2,229,790 | A | 1/1941 | Beuter et al. | |
| 2,372,554 | A | 3/1945 | Thornton | |
| 2,590,008 | A | 3/1952 | Grothey et al. | |
| 2,621,501 | A | 12/1952 | Jenkins | |
| 2,663,175 | A | 12/1953 | Pons | |
| 2,664,726 | A | 1/1954 | Lihn | |
| 2,709,353 | A | 5/1955 | Poole | |
| 2,926,513 | A | 3/1960 | Tew | |
| D189,206 | S | 11/1960 | Thompson | |
| 3,181,316 | A | 5/1965 | Auton | |
| 3,320,774 | A | 5/1967 | Giorgio | |
| 3,338,071 | A | 8/1967 | Pons et al. | |
| 3,477,256 | A | 11/1969 | Fillmore et al. | |
| 3,603,116 | A * | 9/1971 | Turini | D04B 9/56 66/187 |
| 4,341,097 | A | 7/1982 | Cassidy et al. | |
| 4,709,563 | A | 12/1987 | Camiciotti et al. | |
| 4,926,660 | A * | 5/1990 | Takashi | D04B 9/12 66/9 R |
| 5,095,719 | A | 3/1992 | Philip | |
| 5,103,656 | A | 4/1992 | Hanson, II | |
| 5,170,646 | A | 12/1992 | Gariboldi | |
| 5,771,495 | A | 6/1998 | Turner et al. | |
| 5,784,721 | A | 7/1998 | Huff | |
| 6,000,247 | A | 12/1999 | Takeda et al. | |
| 6,012,177 | A | 1/2000 | Cortinovis | |
| 6,016,575 | A | 1/2000 | Prychak | |
| 6,178,781 | B1 * | 1/2001 | Myers | D04B 1/26 66/178 R |
| 6,199,409 | B1 * | 3/2001 | Shibata | D04B 9/38 66/148 |
| 6,286,151 | B1 | 9/2001 | Lambertz | |
| 6,308,337 | B1 | 10/2001 | Penley | |
| 6,318,283 | B1 | 11/2001 | Coulthard | |
| 6,334,222 | B1 | 1/2002 | Sun | |
| 6,460,380 | B1 * | 10/2002 | Sciacca | D04B 1/243 66/21 |
| 6,481,245 | B1 | 11/2002 | Kalde | |
| 6,668,387 | B2 | 12/2003 | Kalde | |
| 6,708,348 | B1 | 3/2004 | Romay | |
| 6,722,163 | B2 | 4/2004 | Ando | |
| D489,887 | S | 5/2004 | Mavis et al. | |
| D495,131 | S | 8/2004 | Mavis et al. | |
| D498,045 | S | 11/2004 | Mavis et al. | |
| D499,879 | S | 12/2004 | Mavis et al. | |
| D509,652 | S | 9/2005 | Cooper | |
| 6,953,141 | B2 | 10/2005 | Haugen | |
| D512,829 | S | 12/2005 | Viveros et al. | |
| 7,059,156 | B2 | 6/2006 | Takeda et al. | |
| 7,069,600 | B1 | 7/2006 | Romay | |
| 7,103,922 | B1 | 9/2006 | Doorley | |
| 7,191,622 | B1 | 3/2007 | Walker et al. | |
| 7,213,417 | B2 | 5/2007 | Lonati et al. | |
| 7,437,896 | B2 | 10/2008 | Hirao et al. | |
| 7,487,555 | B2 | 2/2009 | Takeda et al. | |
| 7,971,280 | B2 | 7/2011 | Kaneda | |
| 8,418,507 | B2 | 4/2013 | Beckler et al. | |
| 8,572,766 | B2 | 11/2013 | Shull et al. | |
| 9,380,831 | B2 | 7/2016 | Craig et al. | |
| 9,476,148 | B2 | 10/2016 | Riaz | |
| 2004/0261466 | A1 | 12/2004 | Takeda et al. | |
| 2005/0235702 | A1 | 10/2005 | Takeda et al. | |
| 2006/0218973 | A1 | 10/2006 | Kim et al. | |
| 2007/0094892 | A1 | 5/2007 | Craig et al. | |
| 2009/0223254 | A1 * | 9/2009 | Ishida | D04B 1/108 66/185 |
| 2011/0192198 | A1 * | 8/2011 | Green | D04B 9/56 66/186 |
| 2015/0000009 | A1 | 1/2015 | Koshida | |
| 2017/0130376 | A1 * | 5/2017 | Brunton | D04B 1/123 |

FOREIGN PATENT DOCUMENTS

| | | | |
|---|---|---|---|
| EP | 1717362 | A1 | 11/2006 |
| JP | 2003013343 | A | 1/2003 |
| JP | 2004250796 | A | 9/2004 |
| JP | 2005307370 | A | 11/2005 |
| JP | 2006028693 | A | 2/2006 |
| WO | 9624262 | A1 | 8/1996 |
| WO | 2009066269 | A1 | 5/2009 |

OTHER PUBLICATIONS

Communication under Rule 71(3) dated Aug. 5, 2019 in European Patent Application No. 18191559.6, 31 pages.

* cited by examiner

SOCK AND A METHOD FOR ITS MANUFACTURE

CROSS-REFERENCE TO RELATED APPLICATION

This Application is a Divisional Application of U.S. application Ser. No. 14/266,023 filed Apr. 30, 2014, and titled "Sock And A Method For Its Manufacture," which in turn is a Continuation-in-Part Application of U.S. application Ser. No. 12/920,220 filed May. 23, 2011, and entitled "Sock And A Method For Its Manufacture." U.S. application Ser. No. 12/920,220 is a National Stage Entry of International Application No. PCT/IL07/01486 filed Dec. 2, 2007, and titled "Sock And A Method For Its Manufacture," which in turn claims priority to U.S. Provisional Application No. 60/868,183 filed Dec. 1, 2006, and titled "Sock Having Advanced Toe And Heel Areas." The disclosure of which are hereby incorporated by reference in their entireties.

BACKGROUND

A sock is a knitted garment used for enclosing and covering the human foot and often also the lower part of the leg. Socks are usually aimed at isolating the foot from the outside temperature, absorbing moisture and sweat, and mitigating friction between the foot and the shoe.

Socks are often made of cotton, wool, polyester, nylon or other materials. They come in many colors and patterns, although the complexity and structure of the patterns is usually limited by the manufacturing techniques in use today.

Commercially manufactured socks are produced using circular knitting machines. These machines employ needles mounted on a cylinder or sometimes a double cylinder. The cylinder spins and the needles interlock loops of yarn. When the knitting process is over, the produced sock usually looks like a tube of cloth, open from both sides. Later on in the process, the sock is moved to a sewing or stitching machine for closing its toe area. Such machines are often referred to as "toe closing machines".

The foregoing examples of the related art and limitations related therewith are intended to be illustrative and not exclusive. Other limitations of the related art will become apparent to those of skill in the art upon a reading of the specification and a study of the figures.

SUMMARY

According to some embodiments, there is provided a sock comprising a toe area, wherein the toe area is divided to at least two sub-areas, wherein a borderline between at least two adjacent sub-areas is essentially vertical.

According to some embodiments, there is provided a sock comprising a toe area, wherein the toe area is divided to at least two sub-areas, wherein a borderline between at least two adjacent sub-areas extends essentially parallel to a central axis of the sock.

According to some embodiments, there is provided a sock comprising a toe area, wherein the toe area is divided to at least two sub-areas, wherein a borderline between at least two adjacent sub-areas comprises a vertical component.

According to some embodiments, there is provided a sock comprising a heel area, wherein the heel area is divided to at least two sub-areas, wherein a borderline between at least two adjacent sub-areas is essentially vertical.

According to some embodiments, there is provided a sock comprising a heel area, wherein the heel area is divided to at least two sub-areas, wherein a borderline between at least two adjacent sub-areas extends essentially parallel to a central axis of the sock.

According to some embodiments, there is provided a sock comprising a heel area, wherein the heel area is divided to at least two sub-areas, wherein a borderline between at least two adjacent sub-areas comprises a vertical component.

According to other embodiments, there is provided a method for manufacturing a sock comprising forming a toe area divided to at least two sub-areas, wherein a borderline between at least two adjacent sub-areas is essentially vertical.

According to other embodiments, there is provided a method for manufacturing a sock comprising forming a heel area divided to at least two sub-areas, wherein a borderline between at least two adjacent sub-areas is essentially vertical.

Forming may include knitting. Forming may include a three-dimensional "needle by needle selection" process. Forming may be performed by at least one needle being in a knitting position and at least one needle being in a miss level position.

The at least two adjacent sub-areas may be essentially integrally formed. The least two adjacent sub-areas may be formed during a knitting process of the sock. The at least two sub-areas may be distinguished from each other by at least one property.

A property may include at least one of: elasticity, strength, softness, isolation, friction, density, thickness, liquid absorption, shock absorption, knitting type, yarn composition, yarn thickness, and yarn count.

Other systems, methods, features and advantages of the invention will be, or will become, apparent to one of ordinary skill in the art upon examination of the following figures and detailed description. It is intended that all such additional systems, methods, features and advantages be included within this description and this summary, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

Exemplary embodiments are illustrated in the referenced figures and drawings. It is intended that the embodiments and figures disclosed herein are to be considered illustrative rather than restrictive.

DETAILED DESCRIPTION

In the following detailed description, numerous specific details are set forth in order to provide a thorough understanding of the invention. However, it will be understood by those skilled in the art that the present disclosure may be practiced without these details and therefore it is not intended to limit the invention to the precise form disclosed.

There is provided, according to some embodiments, a sock including a toe area, a heel area or both, wherein the toe area, the heel area or both, are divided, independently, to at least two sub-areas, wherein the borderline between two adjacent sub-areas is vertical or has a vertical component. The two adjacent sub-areas may essentially be integrally formed, for example, during the knitting process of the sock.

The two adjacent sub-areas may be characterized in different properties (such as elasticity, strength, softness, isolation, friction, density, thickness, liquid (such as sweat) absorption, shock absorption, knitting types (such as plain knitting, terry knitting or any other knitting type), yarn compositions (for example, natural yarns such as cotton and wool yarns, man-made yarns such as viscose yarns, synthetic yarns such as polyester, nylon and polypropylene yarns and the like, and other yarns composition including any combination and ratios of materials), yarn count (such as yarn thickness), yarn physical properties (such as elasticity, strength or any other property), or any combination thereof.

Figure 5:
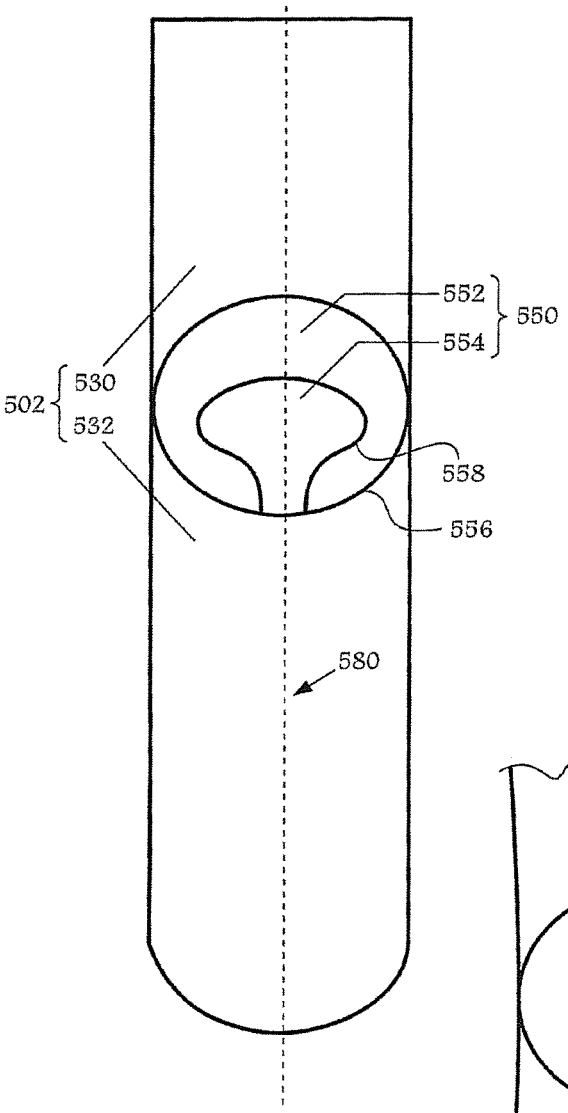
FIG. 5 schematically shows a plan view of a sock, viewed from the rear.

The term vertical as referred to herein may include the direction which extends essentially along the central axis of formation of the sock. In other words, the term vertical as referred to herein may include the longer tubular dimension of the sock. The central axis (which may also be referred to as the longer tubular dimension) of the sock is schematically illustrated in FIG. 5 as central axis 580.

A borderline between at least two adjacent sub-areas is referred to herein as having a "vertical component" if it is not perpendicular to a central axis of formation of the sock, such as central axis 580. Examples of borderlines between at least two adjacent sub-areas having "vertical components" include, line 558 in FIG. 5 and line 104 in FIG. 1.

The toe area and/or the heel area may also be referred to as the reciprocated areas of the sock since there are generally being knitted by a reciprocating process wherein the knitting is performed in a "back and forth" manner as opposed to the spiral continuous knitting that is generally applied for the rest of the sock areas.

Generally, the toe area and/or the heel area are currently being knitted using needle pickers.

According to some embodiments, the toe area and/or the heel area may be knitted according to the three-dimensional "needle by needle selection" process.

Figure 1:
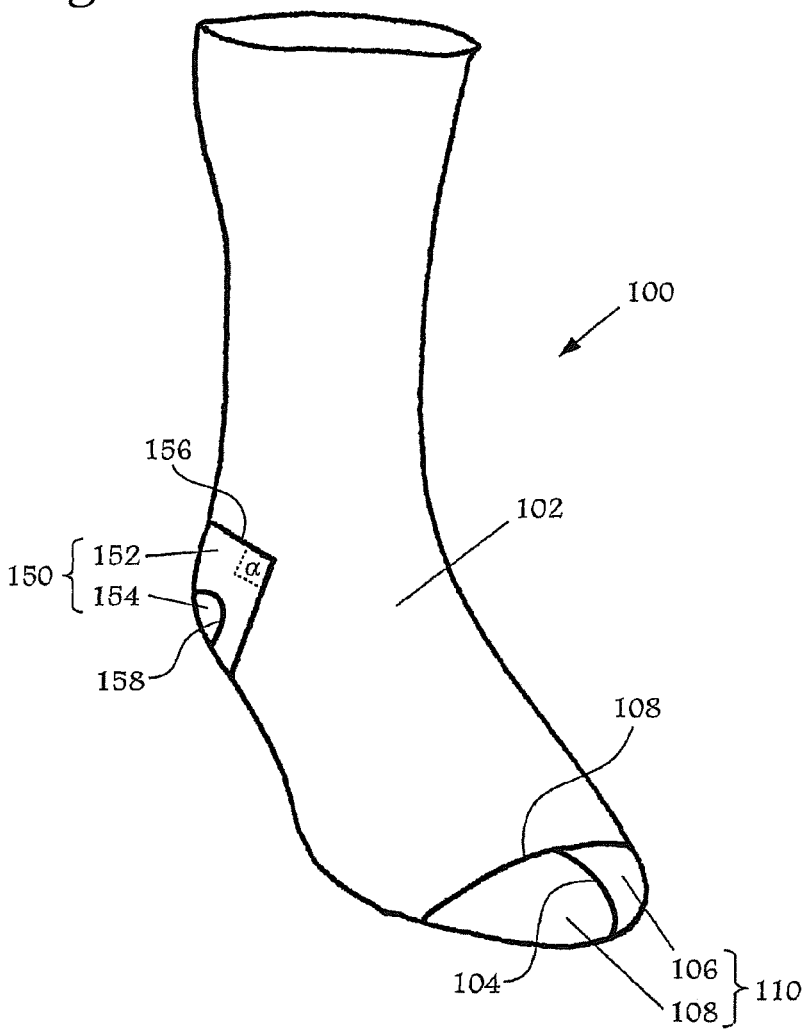
FIG. 1 schematically shows a perspective view of a sock.

Reference is made to FIG. 1, which shows a perspective view of an exemplary sock, shown at 100. Sock 100 may be schematically divided into three areas: a toe area, such as toe area 110, that may include a first toe sub-area ("FITOE"), such as FITOE 106, and a second toe sub-area ("SETOE"), such as SETOE 108; a heel area, such as heel area 150, that may include a first heel sub-area ("FIHEEL"), such as FIHEEL 152, and a second heel sub-area ("SEHEEL"), such as SEHEEL 154; and a residual area, such as residual area 102, that may constitute an area of sock 100 not contained within toe area 110 and heel area 150.

Exemplary sock 100, as can be discerned from the general shape of its outline, may be intended to fit the right foot of a user. It will be understood by persons of skill in the art that the present disclosure applies also to a sock (not shown) that may fit the left foot or a user—such sock (not shown) may be an identical mirror image of sock 100 described herein. In other embodiments (not shown), a pair of socks may include two socks that are not identical mirror images of each other—for example, when a user has feet of different shapes and/or sizes, or when socks with different characteristics are otherwise required.

Toe area 110 and/or heel area 150 of sock 100 may include multiple combinations of yarn types, yarn thicknesses, knitting types and the like. Examples of such combinations, as well as other characteristics of toe area 110 and/or heel area 150 are further described below, in section 1 ("The Toe Area") and section 2 ("The Heel Area").

1. The Toe Area

Exemplary toe area 110 shown in FIG. 1, may be an area essentially surrounding or covering the toes of a user's foot when sock 100 is worn—whereby "surrounding" may include both surrounding the top side of the toes (which may lie essentially under 110) and surrounding the bottom side of the toes (not shown). In other embodiments (not shown), a toe area may essentially surround only the top side of the toes or, alternatively, only the bottom side of the toes. In further embodiments (not shown), a toe area may have a more complex pattern. For example, a toe area may surround portion(s) of the top side of the toes and portion(s) of the bottom side of the toes, as well as optionally include further areas of the sock essentially covering other portion(s) of the user's foot.

Toe area 110 may include, as already noted, FITOE 106 and SETOE 108. Exemplary FITOE 106 may essentially cover a big toe of a user's foot, whereas exemplary SETOE 108 may essentially cover the rest of the user's toes.

Figure 2:
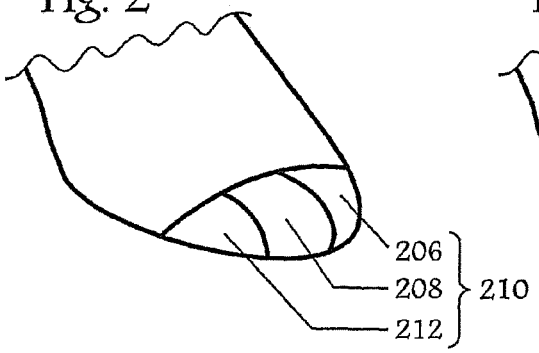
FIG. 2 schematically shows a partial perspective view of a sock.

Referring now to FIG. 2, another embodiment is shown, wherein a toe area, such as toe area 210, may include three sub-areas: a FITOE, such as FITOE 206; a SETOE, such as SETOE 208; and a third toe sub-area ("TITOE"), such as TITOE 212. FITOE 206 may essentially cover a big toe of a user's foot, SETOE 208 may essentially cover the two toes next to the big toe, and TITOE 212 may essentially cover the two toes farthest from the big toe. Other embodiments (not shown) may include a plurality of sub-areas that may essentially correspond to the location of different toes. Furthermore, sub-areas (not shown) may each correspond to the location of groups of one or more toes.

Figure 3:
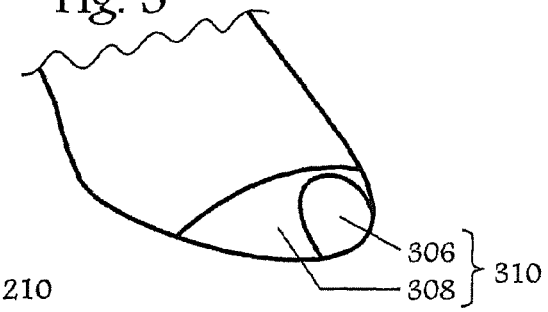
FIG. 3 schematically shows another partial perspective view of a sock.

The embodiments of a toe area shown at 110 in FIG. 1 and at 210 in FIG. 2, may include sub-areas, as described above, that may essentially cover and/or correspond to the location of the user's toes. Such an exemplary embodiment is shown in FIG. 3, wherein a toe area, such as toe area 310, may include a FITOE, such as FITOE 306, and a SETOE, such as SETOE 308. FITOE 306 may have an essentially prolonged oval shape which may extend from approximately above the user's big toe, about the tip of the big toe, and then under the big toe. SETOE 308 may essentially constitute the rest of toe area 310 not contained within FITOE 206.

Similar to exemplary toe area 310 shown in FIG. 3, other embodiments (not shown) may include further combinations of sub-areas, having various shapes, sizes, layouts, patterns and/or paths, which may correspond to the location of the user's toes. It will become apparent to those of skill in the art, that the embodiments of a toe area shown at 110, 210 and 310 in FIGS. 1, 2 and 3, respectively, represent merely three examples of possible shapes, sizes, layouts, patterns and/or paths of sub-areas of a toe area that correspond to the location of the user's toes. Specific embodiments of the sub-areas may be arranged so as to address specific problems relating to a wearer's toes, as discussed herein.

Sub-areas, such as FITOE 106 and SETOE 108 of FIG. 1, FITOE 206, SETOE 208 and TITOE 212 of FIG. 2, and FITOE 306 and SETOE 308 of FIG. 3, may differ than one another in various characteristics. For example, different sub-areas may essentially differ in yarn types, yarn thicknesses, and knitting methods—and such differences may be reflected in a cloth having different attributes. Alternatively, one or more sub-areas of a toe area may share some or all of the same characteristics, whereas other one or more sub-areas of that same toe area may share different or similar sets of some or all of the same characteristics. Additionally, different sub-areas may be knitted, for example, using the same one or more yarns, but the knitting method used to form each sub-area may result in a sub-area having different textures, thicknesses, structures and/or other attributes. Alternatively, the difference in texture, thickness, structure and/or other attributes may be the outcome of using additional combinations of similar or different yarns with similar or different knitting methods, across different sub-areas.

Some of the possible textures, thicknesses and structures of the cloth forming sub-areas, such as FITOE 106 and SETOE 108 of FIG. 1, FITOE 206, SETOE 208 and TITOE 212 of FIG. 2, and FITOE 306 and SETOE 308 of FIG. 3, may be essentially resulting from different methods of knitting, such as terry-knitting (a knitting method often producing a towel-like cloth), plain mesh knitting (a knitting method often producing an essentially flat cloth) and/or tuck stitching (a knitting or stitching method often producing a denser, heavier cloth). These and other knitting methods may be performed in conjunction with different or similar yarn types, or different or similar yarn thicknesses.

Referring now to FIG. 1, sub-areas, such as FITOE 106 and SETOE 108, may essentially abut each other along a borderline, such as first borderline 104, and may both abut a residual area of a sock, such as residual area 102 of sock 100 along a borderline, such as second borderline 108. FITOE 106, SETOE 108 and residual area 102, may be essentially functionally connected or attached to each other by means of stitching. More advantageously, FITOE 106, SETOE 108 and residual area 102 may be essentially integrally formed by means of knitting. Integrally forming these three areas together may be preferred over stitching for multiple reasons. For example, the production process of a sock, such as sock 100, may be faster this way; a sock, such as sock 100, may be more durable and less prone to tearing if its sub-areas are integrally formed.

Figure 4:
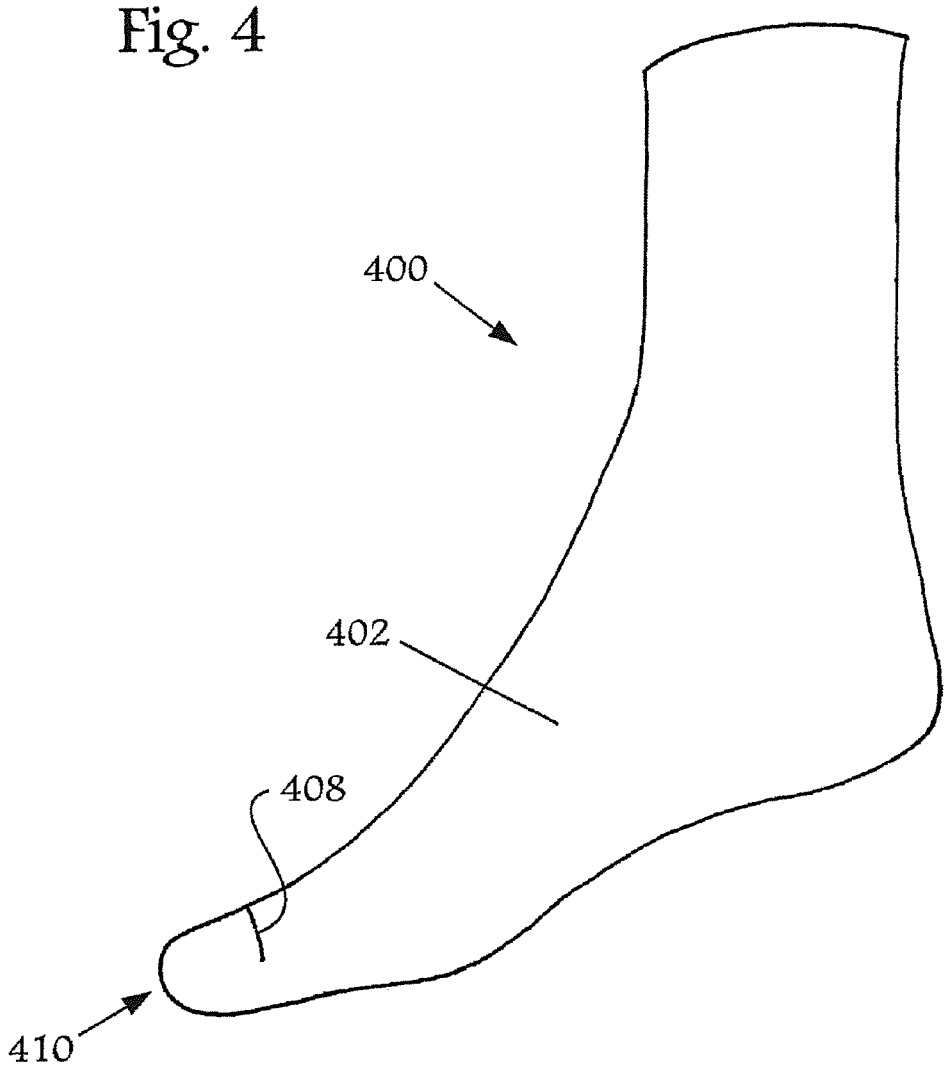
FIG. 4 schematically shows another perspective view of a sock.

However, in some embodiments, a residual area may be essentially stitched to a toe area, while essentially eliminating or mitigating some or all of the disadvantages of stitching mentioned above. Referring now to FIG. 4, an exemplary sock is shown, in a side view, at 400; sock 400 may be identical or similar to sock 100 of FIG. 1. Sock 400 may have a borderline, such as second borderline 408, which may be identical or similar to second borderline 108 of FIG. 1. Second borderline 408 may essentially extend over the top half of sock 400, meaning, it may run above the top side of the user's foot when sock 400 is worn, rather than below the bottom side of the user's foot. In other embodiments (not shown), a second borderline may run below the bottom side of the user's foot. Sock 400 may also have a toe area, such as toe area 410, which may be identical or similar to toe area 110 of FIG. 1, and a residual area, such as residual area 402, which may be identical or similar to residual area 102 of FIG. 1. Residual area 402 and toe area 410 may be essentially stitched to one another along second borderline 408.

Such stitching may be advantageous, in some cases, essentially due to the characteristics of a knitting machine which may be used to knit sock 400, or due to other reasons. Such knitting machine may be a circular knitting machine, which may knit a sock, such as sock 400, in essentially circular patterns. The essentially final product of such a circular knitting machine may be an essentially tubular cloth, open at its two ends (not shown). One of the open ends may be at second borderline 408, although an open position of a sock is not shown in FIG. 4. Essentially after the circular knitting machine had completed producing the tubular cloth, which may be open at its two ends, the tubular cloth may be closed at one end by stitching together a toe area, such as toe area 410, and a residual area, such as residual area 402. Such stitching, as mentioned above, may be sometimes preferred over integrally forming toe area 410 and residual area 402. Firstly, such stitching is common among current regular socks, and therefore it may not be interfering with general usage. Secondly, such stitching may be, on some instances and/or when using certain knitting machines, faster and thereby more efficient than integrally forming toe area 410 and residual area 402.

Referring now to FIG. 1, there are many benefits to forming a sock, such as sock 100, with a plurality of sub-areas, such as FITOE 106 and SETOE 108. For example, a plurality of sub-areas, such as FITOE 106 and SETOE 108, may allow satisfying specific, individual needs of a certain toe or a group of toes, and/or needs of other part(s) of the user's foot. Such needs may be medical needs, needs pertaining to the user's comfort and coziness and/or needs of protecting certain area(s) of the foot against bruising, fluids, sharp objects, undesired temperature and/or other environmental conditions that may be considered by the user as generally undesired. Furthermore, forming a sock, such as sock 100, with at least one sub-area, such as FITOE 106 or SETOE 108, having a relatively thick, heavy and/or dense cloth, may result in better cushioning and/or shock-absorbing of the relevant sub-area(s). In addition, a smoother cloth may prevent rash and/or inflammation of the skin in area(s) of the foot essentially adjacent to that cloth. Moreover, a thicker cloth and/or terry may essentially absorb sweat and/or other liquids, and may additionally isolate part(s) of the foot from undesired high or low temperatures.

2. The Heel Area

Exemplary heel area 150 shown in FIG. 1, may be an area essentially surrounding or covering the heel of a user's foot when sock 100 is worn. In other embodiments (not shown), a heel area may surround portion(s) of the user's heel, as well as portion(s) of other part(s) of the user's foot, such as the ankle.

Heel area 150 may essentially cover the heel of a user's foot, and may have the general shape of a hemisphere. When viewed perspectively from the side, heel area 150 may appear to have an outline with two 90.degree. angles two of its opposite sides—one of these angles, located on the right side of sock 100, is shown at .alpha., and the opposite angle is not visible in FIG. 1. In other embodiments, the angles may have different measurements—for example, 95.degree., 85.degree., 81.degree. or the like. The essentially hemispherical shape of heel area 150 may become more apparent when viewed from the rear side of sock 100. Such view is illustrated in FIG. 5, in which a heel area, that may be identical or similar to heel area 150 of FIG. 1, is shown at 550. As can be noticed when observing FIG. 5, heel area 550 may have a round or a somewhat oval outline when viewed from the rear. The round or somewhat oval shape of heel area 550 may be, as already noted, essentially hemispherical, having a sphericity elevating generally towards the viewer—and therefore not observable in FIG. 5. Further observing now FIG. 5, a residual area, such as residual area 102 of FIG. 1, is shown at 502. The upper part of residual area 502, that is shown at 530, may essentially be directed towards the top opening of a sock (only partially shown in FIG. 5, and shown in whole at 100 in FIG. 1), whereas the lower part of residual area 502, that is shown at 532, may be directed towards the lower end and a toe area, such as toe area 110 shown in FIG. 1, of a sock, (only partially shown in FIG. 5, and shown in whole at 100 in FIG. 1).

Referring now to FIG. 1, heel area 150 may include a FIHEEL, such as FIHEEL 152, and a SEHEEL, such as SEHEEL 154. FIHEEL 152 and SEHEEL 154 may constitute adjacent regions of heel area 150. Exemplary SEHEEL 154 may extend over an essentially central portion of heel area 150, and may have the shape of essentially an ellipse extending horizontally, a central part of which is essentially perpendicularly protruding downwards. The shape of SEHEEL 154 may be better observed in FIG. 5, which shows it, at 554, from a rear view. SEHEEL 554 may be essentially located, when sock 100 of FIG. 1 is worn, below an area of the user's heel applying an essentially substantial force resulting from the user's body weight.

Similar to the exemplary heel area shown at 150 and 550 in FIGS. 1 and 5, respectively, other embodiments (some are not shown) may include further combinations of sub-areas, such as FIHEEL 152 and 552 and SEHEEL 154 and 554 shown in FIGS. 1 and 5, respectively, optionally having various shapes, sizes, layouts, patterns and/or paths. For example, referring now to FIG. 6, a heel area, such as heel area 650, may be essentially vertically divided into two halves—a FIHEEL, such as FIHEEL 652, and a SEHEEL, SEHEEL 654.

Figure 6:
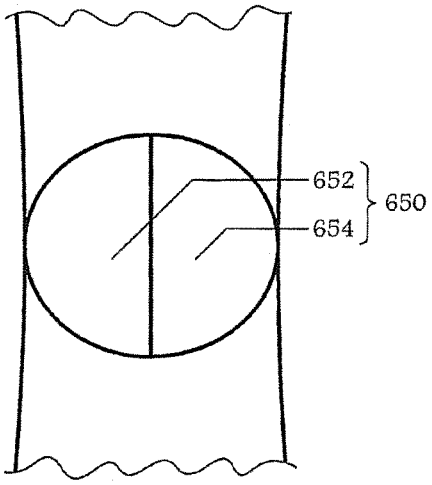
FIG. 6 schematically shows a partial plan view of the heel area of a sock, viewed from the rear.

It will become apparent to those of skill in the art, that the embodiments of a heel area shown at 150, 550 and 650 in FIGS. 1, 5 and 6, respectively, represent merely three examples of possible shapes, sizes, layouts, patterns and/or paths of sub-areas of a heel area. Specific embodiments of the heel area may address specific problems relating to a wearer's heel, as described herein.

Similar to what was disclosed herein in section 1 ("The Toe Area"), sub-areas of a heel area, such as FIHEEL 152, 552 and 652, SEHEEL 154, 554 and 654 of heel area 150, 550 and 650 shown in FIGS. 1, 5 and 6, respectively, may also abut each other, as well as optionally abut a residual area, such as residual area 102 and 502 shown in FIGS. 1 and 5, respectively. Such abutting may occur along borderlines, such as third borderline 156 and fourth borderline 158 shown in FIG. 1, and along respective third borderline 556 and fourth borderline 558 shown in FIG. 5. The different methods of essentially functionally connecting, attaching or integrally forming different sub-areas and/or a residual area, may be similar to the methods already disclosed herein in section 1. It will become apparent to those of skill in the art, that methods such as those disclosed in section 1, are fully applicable here, and therefore do not require repetition.

Additionally, descriptions of combinations of yarn types, yarn thicknesses, knitting types and the like, that were already disclosed in section 1, may apply also to a heel area, such as heel area 150, 550 and 650 shown in FIGS. 1, 5 and 6, respectively. It will become apparent to those of skill in the art, that yarn types, yarn thicknesses, knitting types and the like, such as those disclosed in section 1, are fully applicable here, and therefore do not require repetition.

Furthermore, it will become apparent to those of skill in the art, that the description in section 1 of benefits and advantages of forming a sock, such as sock 100 shown in FIG. 1, with multiple sub-areas of a heel area, such as FIHEEL 152, 552 and 652, SEHEEL 154, 554 and 654 of heel area 150, 550 and 650 shown in FIGS. 1, 5 and 6, respectively, is fully applicable here, and therefore does not require repetition. In addition to what was disclosed in section 1, the specified shape and/or location of a SEHEEL, such as SEHEEL 554 shown in FIG. 5, may be especially advantageous in cushioning and/or supporting an area of the user's heel located essentially above it when the sock, such as sock 100 shown in FIG. 1 is worn. Such area of the user's foot may concentrate an essentially substantial force, resulting from the user's body weight and applied essentially downwards. Therefore, providing a SEHEEL, such as SEHEEL 554 shown in FIG. 5, having cushioning and/or supportive characteristics (such as when forming it with a relatively soft, rigid and/or soft cloth) may be advantageous.

Figure 7:
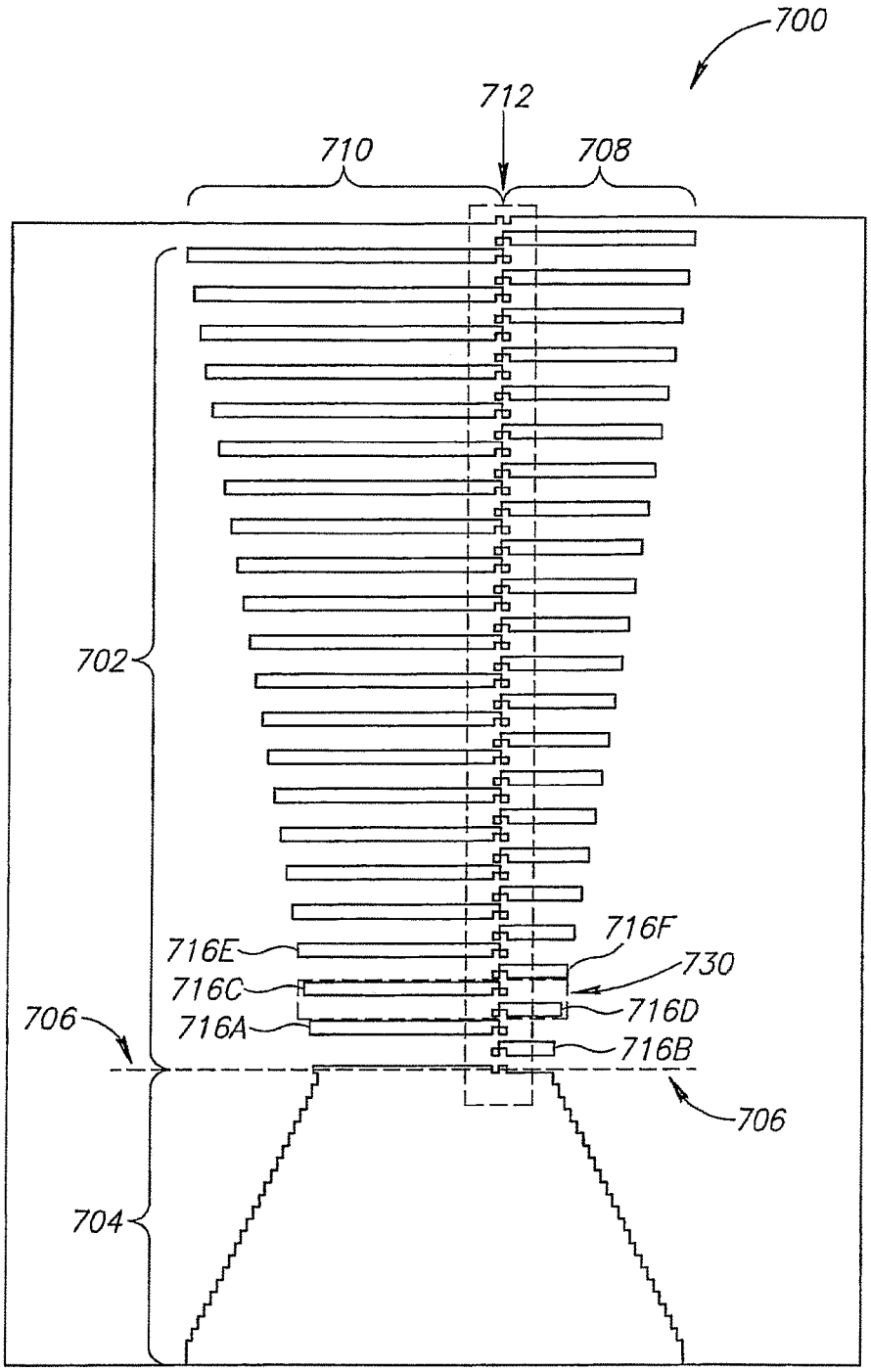
FIG. 7 schematically shows a plan view of a knitting pattern.

Reference is now made to FIG. 7, which schematically illustrates a knitting pattern of toe area, according to some exemplary embodiments. The knitting pattern 700 include a top side 702 (which is adapted to fit the top side of the toes) and a bottom side 704 which is adapted to fit the bottom side of the toes. The top side 702 and the bottom side 704 are separated by line 706 (which may optionally an imaginary line). The top side 702 includes two sub areas, namely, sub-area 708 and sub-area 710 which are separated by a separating zone 712 which extends in parallel to the central axis of formation of the sock. Each one of sub-area 708 and sub-area 710 includes horizontal knitted sections 716 (which extends perpendicular to the central axis of formation of the sock) such as sections 716 *a-f*. Knitted sections 716 *a, c* and *e* of sub-area 710 are intermittently positioned and with knitted sections 716 *b, d* and of sub-area 708. The knitted sections of sub-area 710, such as knitted sections 716 *a, c* and the knitted sections of sub-area 708, such as knitted sections 716 *b, d* and *f* are intermittently positioned and partially overlap in the separating zone 712. The bottom side 704 shown herein includes only one sub-area, but may include two or more sub-areas, such as those described for the top side 702.

FIG. 7 shows only an example of possible knitting pattern. Other knitting patterns are also covered herein. These knitting patterns may include, for example, one or more curved separating zone located in the center of the top and/or bottom heel and/or toe areas.

Figure 8:
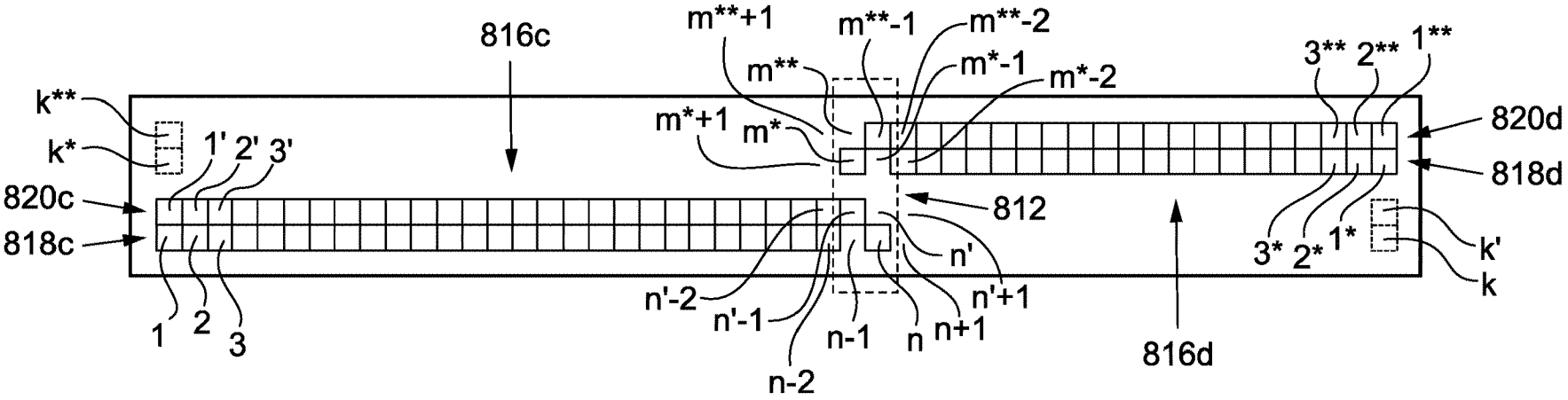
FIG. 8 schematically shows a magnified plan view of knitting area 730 of FIG. 7.

FIG. 8 schematically shows a magnified plan view of the knitting area 730 of FIG. 7.

Knitted section 816 *c* includes two parallel and adjacent knitted lines also referred to as knitted courses or courses, namely knitted line 818 *c* and knitted line 820 *c*. Each one of knitted line 818 *c* and knitted line 820 *c* includes a plurality of abutting columns. The columns of knitted line 818 *c* are sequentially numbered 1, 2, 3, . . . , n, n+1, . . . , k. The columns of knitted line 820 *c* are sequentially numbered 1', 2', 3', . . . , n'−1, n', n'+1, . . . , k'. Each column represents the potential location of a needle. The needles (not shown), which are adapted to operate in a "selected needle by needle" mode can be in a knitting position (in other words in a "clear level"), if selected to knit, or in a "miss level" position, wherein the needle will not knit. Therefore, columns which represent needles in a knitting position (clear level) will include a knitted loop and columns, which represent miss needles will not include a knitted loop.

The number of columns in knitted line 818 *c* is k. Columns 1 to n−2 and n include knitted loops, while column n−1 and columns n+1 to k do not include a knitted loop.

The number of columns in knitted line 820 *c* is k'. Columns 1 to n'−1 include knitted loops. Columns n' to k' do not include knitted loops. The number n may be equal to n'. The number k may be equal to k'.

Knitted section 816 *d* includes two parallel and adjacent knitted lines, namely knitted line 818 *d* and knitted line 820 *d*. Each one of knitted line 818 *d* and knitted line 820 *d* includes a plurality of abutting columns. The columns of knitted line 818 *d* are sequentially numbered (from the opposite side relative to the numbering of knitted line 818 *c* and knitted line 820 *c*) 1*, 2*, 3* . . . , m* m*+1, . . . , k*. The columns of knitted line 820 *c* are sequentially numbered 1, 2, 3, . . . , n−1, m, m+1 . . . k. Each column represents the potential location of a needle. The number of columns in knitted line 818** *d* is k*. Columns 1* to m*−2 and m* include knitted loops, while column m*−1 and columns m*+1 to k* do not include a knitted loop.

The number of columns in knitted line 820 *d* is k. Columns 1 to m−1 include knitted loops. Columns m to k do not include knitted loops. The number m* may be equal to m**. The number k may be equal to k', to k* and/or to k**.

The separating zone 812 includes columns n, n−1 in parallel to n', n'−1 in parallel to m*, m*−1 in parallel to m, m−1, which when repeated multiple times results in a zipper like structure. Of course any other knitting pattern that may result in a zipper like structure that is located between two adjacent sub-areas is covered under the scope of this disclosure. For example, wherein any one (one or more) of columns n, n−1, n', n'−1, m*, m*−1, m, m−1 (or any other column) may represent two or more separating needles or needle positions and may thus result in two or more loops when knitted.

Of course other patterns that may include other separating zones having other numbers and or arrangements of columns.

3. A Knitting Process, According to Some Embodiments

EXAMPLES

The following non-limiting options (examples) are for illustrative purposes; of course other configuration of yarn fingers and/or types of yarn (material, properties and like) may be used in any possible combination. For example, the plaiting yarn(s) and/or the background yarn(s) may be knitted through any other yarn finger or any combinations of yarn fingers.

Option 1: One plaiting yarn for the heel and/or toe with different background. The plaiting yarn is knitted through yarn finger No. 4. The background yarns in the different areas (such as areas A and B) are knitted through yarn fingers as follows: No. 3—sub-area 708 No. 5—sub-area 710.

Option 2:

Different plaiting yarn for the heel and/or toe areas with different background. The plaiting yarns are knitted through yarn fingers No. 4—sub-area 710 No. 2—sub-area 708. The background yarns in the different areas (such as areas A and B) are knitted through yarn fingers as follows: No. 3—sub-area 708 No. 5—sub-area 710.

The reciprocated areas of the sock, such as the heel and/or the toe areas, may by knitted with a knitting principle of the three dimensional knitting by the use of selection of needles (such as electronic selection of needles) and optionally without the usage of the needle pickers.

On the first course (for example, when starting knitting a line) forward rotation of the reciprocated part of the sock is performed, while two yarn fingers are entering to the knitting process (yarn fingers 4 & 5, which are the yarns of sub-area 710) and all other yarn fingers are temporarily inactive. Each of the consecutive needles knit in the same line, however the last needle of sub-area 710 is missed. On the same line, the first needle of sub-area 708 is clear needle (the needle knits) and all other needles in this line are in miss level (do not knit). The second course (course 2) is a backward rotation and all needles are in miss level. On that course (course 2) in option 1 yarn finger 3 is going in, in option 2 yarn fingers 2&3 are going in (yarns of sub-area 708). The next course (course 3) is forward rotation course. Yarns of sub-area 710 are going out and only the selected consecutive needles of sub-area 708 are in clear level while all the others are in miss level. On the next backward rotation (course 4) the last needle of sub-area 710 is in clear level, the first needle of sub-area 708 is in miss level and only the consecutive needles of sub-area 708 (besides the first) are in clear levels while all the others are in miss levels. On the next forward course (course 5) all needles are in miss level, the yarns of sub-area 710 are going in. On the next backward rotation (course 6), yarn fingers of sub-area 708 are going out, only the needles of sub-area 710 are in clear level while all the others are miss needles. On the next forward rotation (course 7), the last needle of sub-area 710 is miss needle, the first of sub-area 708 is clear needle and only the rest of the consecutive needles of 710 area are clear needles while all the other are miss needles.

From this point the process repeats on courses 2 to 7 until the end of the reciprocated part of the sock. The position of the binding line of the two areas may be changed according to the design of the sock.

While a number of exemplary aspects and embodiments have been discussed above, those of skill in the art will recognize certain modifications, permutations, additions and sub-combinations thereof. It is therefore intended that the following appended claim and claims hereafter introduced be interpreted to include all such modifications, permutations, additions and sub-combinations as are within their true spirit and scope.

While various embodiments of the invention have been described, the description is intended to be exemplary, rather than limiting and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

What is claimed is:

1. A method of knitting a borderline between two adjacent regions in a knitted garment, the method comprising:

on a circular knitting machine having a series of consecutive needles grouped into a first sub-area of needles, a second sub-area of needles, and at least two separating needles positioned between the first sub-area of needles and the second sub-area of needles:

forming a first course of knitted stitches by feeding a first yarn from a first finger and moving the circular knitting machine in a first direction while knitting at consecutive needles in the first sub-area of needles, executing a miss at a first separating needle directly adjacent to the first sub-area of needles, knitting at a second separating needle directly adjacent the second sub-area of needles, and not knitting at consecutive needles in the second sub-area of needles;

moving the circular knitting machine in a second direction that is opposite to the first direction while the series of consecutive needles are in a miss position and while positioning a second finger to feed a second yarn;

forming a second course of knitted stitches with the second yarn by moving the circular knitting machine in the first direction and by knitting at the second separating needle and at the consecutive needles in the second sub-area of needles, wherein forming the second course of knitted stitches includes not knitting at the consecutive needles in the first sub-area of needles and not knitting at the first separating needle;

forming a third course of knitted stitches with the second yarn by moving the circular knitting machine in the second direction and by knitting at the consecutive needles in the second sub-area of needles and at the first separating needle, wherein forming the third course of knitted stitches includes not knitting at the consecutive needles in the first sub-area of needles and not knitting at the second separating needle;

moving the circular knitting machine in the first direction while the series of consecutive needles are in a miss position and while positioning the first finger to feed the first yarn;

forming a fourth course of knitted stitches with the first yarn by moving the circular knitting machine in the second direction and by knitting at the consecutive needles in the first sub-area of needles and at the first separating needle, wherein forming the fourth course of knitted stitches includes not knitting at the consecutive needles in the second sub-area of needles and not knitting at the second separating needle; and repeating the forming of the first, second, third, and fourth courses at subsequent courses.

2. The method according to claim 1, wherein the first yarn comprises a different yarn composition from the second yarn.

3. The method according to claim 1, wherein the consecutive needles in the first sub-area of needles are configured to knit a first stitch type, and wherein the consecutive needles in the second sub-area of needles are configured to knit a second stitch type that is different from the first stitch type.

4. The method according to claim 3, wherein the first stitch type and the second stitch type comprises one or more of a terry stitch, a plain-mesh stitch, and a tuck stitch.

5. The method according to claim 3, wherein the first stitch type results in a first texture, and the second stitch type results in a second texture.

6. The method according to claim 5, wherein the first texture is different from the second texture.

7. The method according to claim 1, wherein the first yarn comprises a first thickness and the second yarn comprises a second thickness.

8. The method according to claim 7, wherein the first thickness of the first yarn is different from the second thickness of the second yarn.

9. The method according to claim 1, wherein the borderline is located at a toe portion of the knitted garment.

* * * * *